United States Patent [19]

Fuss

[11] Patent Number: 5,011,064

[45] Date of Patent: Apr. 30, 1991

[54] METHOD OF MANUFACTURING A DOUBLE-WALLED TUBE

[76] Inventor: Heinrich Fuss, Schorenweg 44, D-4788 Warstein 1, Fed. Rep. of Germany

[21] Appl. No.: 501,971

[22] Filed: Mar. 29, 1990

Related U.S. Application Data

[63] Continuation of Ser. No. 72,262, Jun. 19, 1987, abandoned.

[51] Int. Cl.[5] ..... B23K 31/02; B23K 37/04; B21D 39/04

[52] U.S. Cl. ..... 228/151; 72/51; 228/212

[58] Field of Search ..... 72/51, 52, 368, 370; 228/17.5, 129, 130, 143, 144, 146, 147, 151, 44.3, 212

[56] References Cited

U.S. PATENT DOCUMENTS

| | | | |
|---|---|---|---|
| 1,752,061 | 3/1930 | Cameron | 228/151 |
| 1,816,534 | 7/1931 | Hume | 228/151 |
| 2,387,051 | 10/1945 | Blatz | 228/130 |
| 3,732,614 | 5/1973 | Boutell | 228/212 X |
| 4,570,843 | 2/1986 | Matsuzaki et al. | 228/151 |
| 4,675,496 | 6/1987 | Toyoshima et al. | 228/44.3 X |

FOREIGN PATENT DOCUMENTS

| | | | |
|---|---|---|---|
| 966988 | 5/1975 | Canada | 228/17.5 |
| 874393 | 4/1953 | Fed. Rep. of Germany | 228/129 |
| 2503025 | 7/1976 | Fed. Rep. of Germany | 72/51 |

*Primary Examiner*—E. Michael Combs
*Attorney, Agent, or Firm*—Spencer & Frank

[57] ABSTRACT

A device for making a doubled-walled pipe having a wear-resistant internal pipe and a shock-resistant external pipe. The internal pipe is prefabricated. The external pipe is made from an initial pre-curved metal sheet. The shaping of the external pipe around the internal pipe is effected by means of tools which are pressed against the metal sheet. The parts of the tools are placed directly on the metal sheet on at least three lines distributed around the circumference and extending longitudinally over the length of the sheet. Using the parts of the tools, a clamping force is applied to the metal sheet perpendicularly or parallel to the edge of the metal sheet which is placed around the internal pipe to form the doubled-walled pipe.

19 Claims, 3 Drawing Sheets

METHOD OF MANUFACTURING A DOUBLE-WALLED TUBE

This application is a continuation of application Ser. No. 07/072,262, filed June 19, 1987 abandoned.

BACKGROUND OF THE INVENTION

1. Field of the Art

The invention relates to a device for the production of pipes composed of a wear resistant inner pipe and a shock and impact resistant outer pipe, with the inner pipe being prefabricated and the outer pipe being formed from a previously bent metal starting sheet which is shaped by bending it around the inner pipe and welding together its abutting longitudinal edges.

2. State of the Art

A device for producing pipes composed of a prefabricated inner pipe and an outer pipe formed by bending it around the inner pipe and welding together its abutting longitudinal edges is disclosed in U.S. Pat. No. 2,373,163. In the prior art device, four rollers engage the starting sheet, two in the region where it lies and two diametrally opposite one another in the region defined by the horizontal diameter of the starting sheet. All rollers are mounted so as to be pivotal directly or indirectly. While the starting sheet is being placed around the inner pipe, they roll along the starting sheet, with the respective diametrally oppositely disposed rollers moving into the region of the abutting longitudinal edges. The prior art device is expensive. Because of the use of rollers, it does not permit optimal application of pressure to the starting sheet. In particular, it has been found to be a drawback that the tools, here in the form of rollers, move along the circumference of the outer sheet. Consequently, pressure is applied radially successively from different directions. The distance between the lower and the upper rollers becomes greater. The danger exists that, particularly in the region between the rollers, contact between the inner pipe and the outer pipe would not be proper.

Another device for producing pipes is disclosed in DE-OS U.S. Pat. No. 3,226,776. The device disclosed in detail in this patent application (published without examination) is used to shape the metal starting sheet of the outer pipe, starting with a coil, in the form of a spiral around the completely shaped and welded inner pipe. Thereafter, the edges of the turns at the exterior surface of the spiral are welded together. The spiral shape results in a long weld seam; a complicated and expensive device is required to produce the pipe. In the method additionally disclosed in this patent application, a previously bent metal starting sheet for the outer pipe is shaped around the inner pipe which has been welded together along the longitudinal seam. Thereafter, the abutting longitudinal edges of the starting sheet are welded together. However, it is not considered to be possible in this method to realize sufficient engagement of the starting sheet with the pipe jacket of the inner pipe, particularly at the ends of the pipe; and this, although the increase in volume of the material of the inner pipe during hardening is to be exploited.

SUMMARY OF THE INVENTION

It is the object of the invention to provide a device of the above-mentioned type in which the tool presses the metal starting sheet directly onto the inner pipe and in an unchanging direction. According to the invention, this is accomplished in that the tool is provided with elements which lie directly against the starting sheet on at least three unchanging lines distributed over the circumferential direction and extending longitudinally along the length of the pipe, with pressure being applied to the starting sheet along these lines perpendicularly or parallel to the gap defined between the edges of the starting sheet placed around the inner pipe.

In the present invention, the tool and its elements grip directly around the metal starting sheet which is to be shaped into the outer pipe along unchanging lines/regions of the starting sheet. Sufficient pressure is applied in an unchanging direction to ensure that the starting sheet is compressed along its longitudinal seams. Tests have shown that pipes result which meet all requirements.

BRIEF DESCRIPTION OF THE DRAWINGS

The drawings are schematic front views of the tools employed in the invention. It is shown in.

DETAILED DESCRIPTION OF THE PREFERRED EMBODIMENTS

Figure 1:
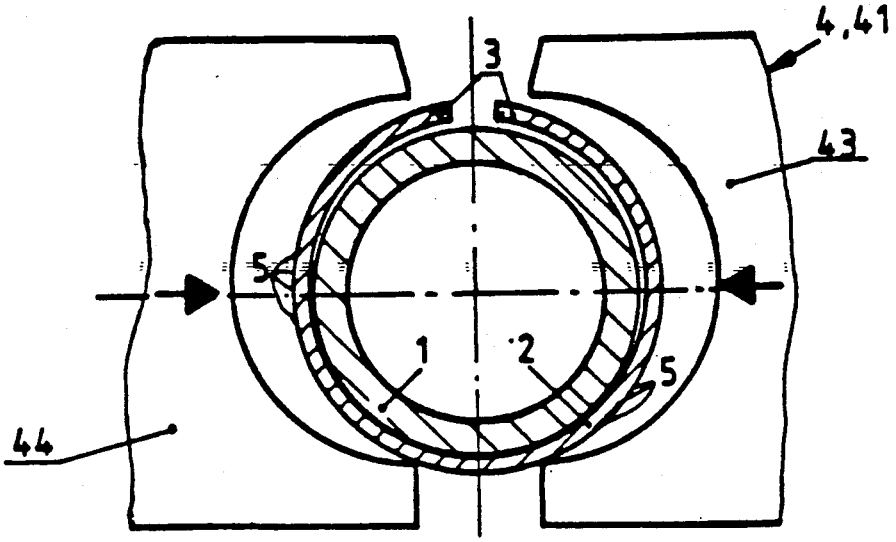
FIG. 1, a two-part shell-type tool.

The pipe to be produced includes a wear resistant inner pipe 1. Inner pipe 1 is prefabricated. Additionally, the pipe includes a shock and impact resistant outer pipe. The outer pipe is formed of a previously bent metal starting sheet 2 which is shaped around inner pipe 1 by bending and is welded together along its abutting longitudinal edges 3.

Shaping the outer pipe around inner pipe 1 is effected with the aid of tools 4 that are pressed against starting sheet 2. The elements of tools 4 contact starting sheet 2 along at least three lines 5 which are distributed over the circumference of the pipe and extend longitudinally over the length of the pipe.

Figure 2:
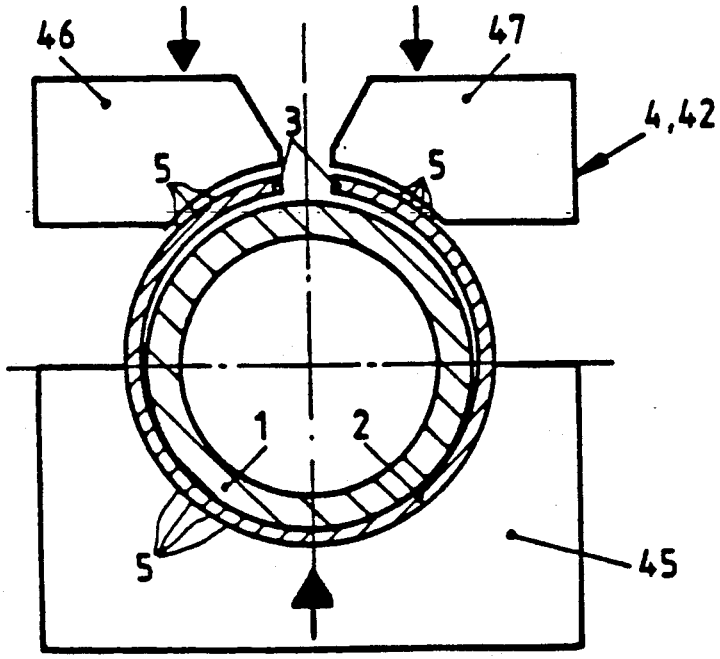
FIG. 2, a three-part shell-type tool.

The tools 4 shown in FIGS. 1 and 2 are shell-type tools 41, 42. The inner diameter of shell-type tools 41, 42 is equal to the outer diameter of the outer pipe. Shaping shells 41, 42 lie against outer sheet 2 along an infinite number of lines 5, particularly in the final state when longitudinal edges 3 have been pressed against one another.

Shell-type tool 41 shown in FIG. 1 has two parts. Shells 43, 44 of shell-type tool 41 are mirror images of each other. Starting from longitudinal edges 3, each shell 43, 44 grips around about one half of a starting sheet 2 which has been placed around inner pipe 1. Shells 43, 44 are moved toward one another in the direction of the arrow, thus pressing longitudinal edges 3 against one another and enabling them to be welded together.

In the embodiment shown in FIG. 2, a three-part shell-type tool 42 is employed. One shell 45 grips outer sheet 2 diametrally opposite longitudinal edges 3 of outer sheet 2. The other two shells 46, 47 are mirror images of each other. In the regions adjacent longitudinal edges 3, they grip around outer sheet 2 which has been placed around inner pipe 1. Shells 45 and 46, 47 are moved toward one another in the direction of the arrow. A force component acts on the starting sheet in the sense of placing longitudinal edges 3 against one another.

Figure 3:
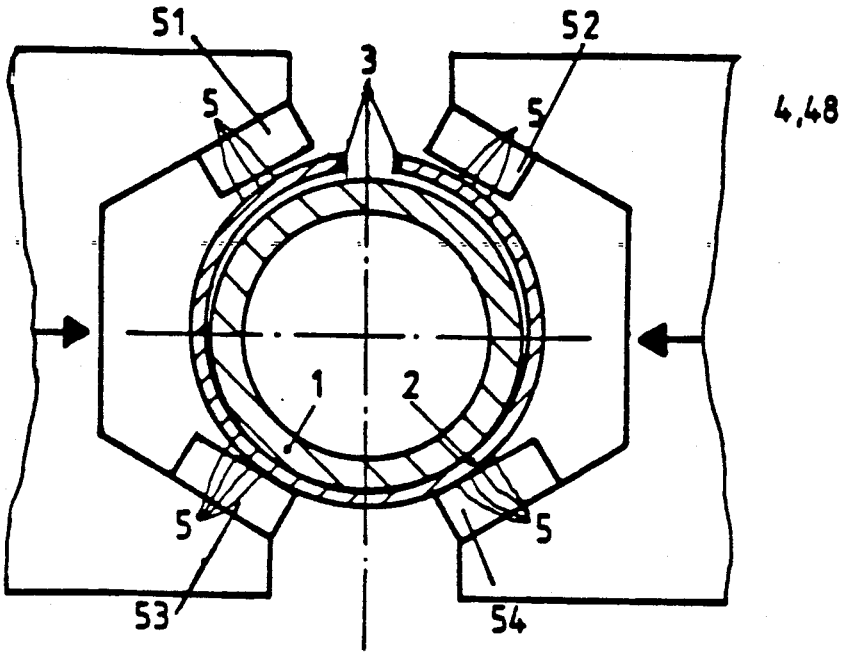
FIG. 3, a linear action tool comprising four contact elements with which pressure is applied from the sides.
Figure 4:
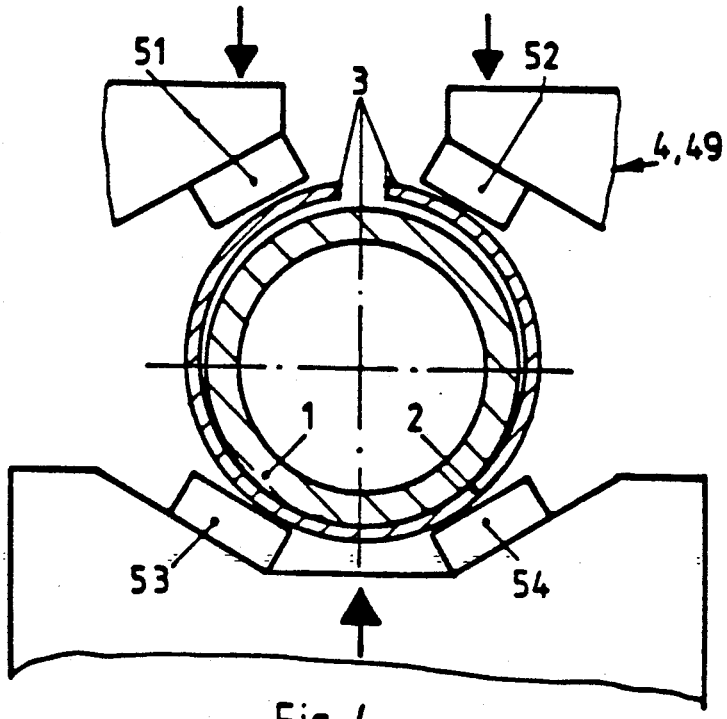
FIG. 4, a linear action tool comprising four contact elements with which pressure is applied from the top and bottom.

In the embodiments shown in FIGS. 3 and 4, four linear action tools 48, 49 equipped with four contact elements are employed as the tools. Each contact element of linear action tool 48, 49 lies against metal starting sheet 2 along one of lines 5. Two elements 51, 52 of linear action tool 48, 49 are provided in the regions adjacent longitudinal edges 3 of starting sheet 2 placed around inner pipe 1, the other two elements 53, 54 each lie in a region of starting sheet 2 disposed diametrically opposite one of the first regions. The contact elements are moved in the direction of the arrow with a force component in the sense of placing longitudinal edges 3 against one another.

Instead of the linear action tool having four contact elements, a linear action tool having three contact elements can also be employed. In such a linear action tool, one element is provided - for example analogously to the shell-type tool of FIG. 2 - diametrally opposite longitudinal edges 3, the other two elements in the regions adjacent the longitudinal edges of starting sheet 2 placed around inner pipe 1.

Figure 5:
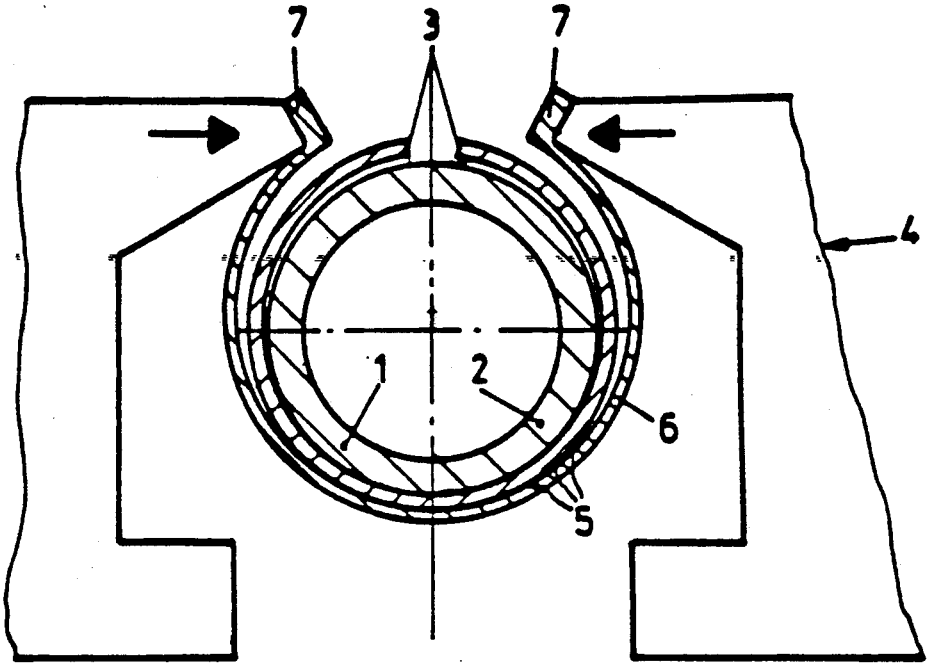
FIG. 5, a tool including at least parts of a pipe casing.

The tool 4 shown in FIG. 5 includes a pipe casing 6. The ends 7 of pipe casing 6 are angled and lie against opposite elements of the two-part tool 4 which move toward one another in the direction of the arrow. Pipe casing 6 contracts and thereby compresses longitudinal edges 3 of the starting sheet against one another which are welded together. Instead of the complete pipe casing, parts thereof spaced from one another in the manner of rings can also be used.

Figure 6:
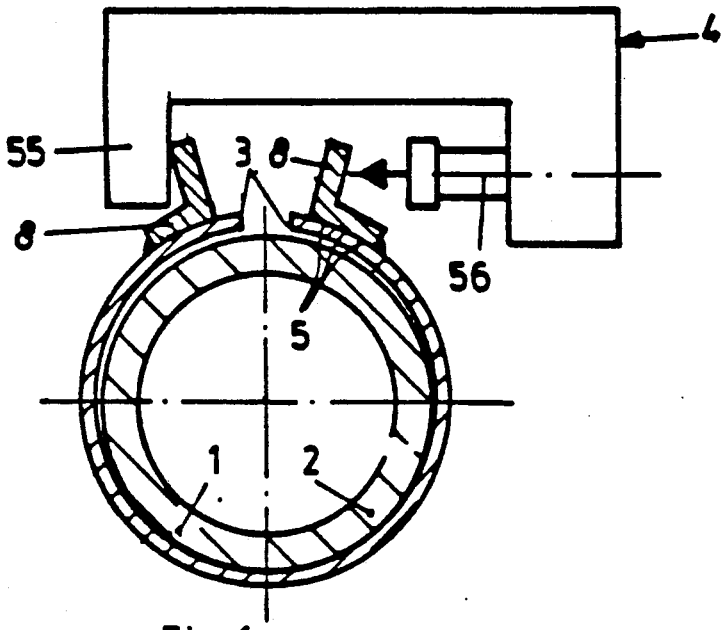
FIG. 6, a tool including fastening shoes.

In the tool 4 shown in FIG. 6, shoes 8 are employed, one of which is fastened to starting sheet 2 in each region of edges 3. One shoe 8 lies against a stationary arm 55 of tool 4, the other shoe comes in contact with the free end of a piston 56 if tool 4 is operated. Piston 56 presses the contacting shoe 8 in the direction of the arrow, i.e. toward stationary shoe 8, thus pressing longitudinal edges 3 against one another and enabling them to be welded together. Shoes 8 are removed after starting sheet 2 has been welded.

BEST MODE OF THE INVENTION

The best modes for implementation of the invention are described above with reference to FIGS. 1 and 2.

COMMERCIAL UTILITY

The invention is commercially utilizable in the field of the manufacture of pipes which are produced of a wear-resistant inner pipe and a shock and impact resistant outer pipe. These pipes can be used in the conveyance of solid matter, particularly for pneumatic packings in mining operations.

It will be understood that the above description of the present invention is susceptible to various modifications, changes and adaptations, and the same are intended to be comprehended within the meaning and range of equivalents of the appended claims.

I claim:

1. A method of manufacturing a double-walled tube comprising the steps of:

(1) providing a wear-resistant prefabricated nonslotted inner pipe having a predetermined outer diameter and a predetermined wall thickness;

(2) arranging around said prefabricated inner pipe a shock and impact resistant previously bent sheet metal single-wall slotted tube which has longitudinal edges and a longitudinally extending slot defined by the longitudinal edges;

(3) applying pressing forces along at least three unchanging lines extending longitudinally along the wall of the slotted tube for holding substantially stationary and pressing the slotted tube tightly against said prefabricated nonslotted inner pipe for eliminating gaps between the prefabricated inner pipe and the slotted tube so that the inner diameter of the slotted tube substantially attains the predetermined outer diameter of the prefabricated inner pipe for bringing the longitudinal edges into an abutting relationship to define a longitudinal welding gap and for forming the outer pipe of the double-walled pipe without changing the predetermined outer diameter and the predetermined pipe wall thickness of the inner pipe; and (4) welding along the longitudinal welding gap of the slotted tube while the slotted tube is held tightly against the prefabricated inner pipe during said step of applying pressing forces.

2. A method according to claim 1, wherein said step of applying pressing forces includes pressing and shaping the slotted tube around the nonslotted inner pipe with a single mechanical movement by a multiple-part linear action tool.

3. A method according to claim 2, wherein the multipart linear action tool of said pressing and shaping step comprises three contact elements, one of said elements being positioned diametrically opposite the longitudinal edges of the slotted tube, and said other two contact elements being positioned in regions adjacent the longitudinal edges.

4. A method according to claim 2, wherein the multipart linear action tool of said pressing and shaping step comprises four contact elements, two of said elements are positioned in first regions adjacent the longitudinal edges, and said other two contact elements are positioned in regions near the slotted tube diametrically opposite said first regions.

5. A method according to claim 1, wherein said step of applying pressing forces includes pressing and shaping the slotted tube around the nonslotted inner pipe with a single mechanical movement by a multiple-part shell-type tool, wherein said shell-type tool has an inner diameter corresponding to the outer diameter of the outer pipe.

6. A method according to claim 5, wherein said multipart shell-type tool of said pressing and shaping step comprises a two-part shell-type tool, and each said shell grips around approximately one-half of the slotted tube starting at the longitudinal edges.

7. A method according to claim 5, wherein said multipart shell-type tool of said pressing and shaping step comprises a three-part shell-type tool, said one shell grips the slotted tube diametrically opposite the longitudinal edges, and said other two shells grip the slotted tube in regions adjacent the longitudinal edges.

8. A method according to claim 1, wherein said step of applying pressing forces includes forming the outer pipe of the doubled-walled pipe with a single mechanical movement by a tool means comprising a pipe casing having a plurality of parts for positioning around the slotted tube.

9. A method according to claim 8, wherein said pipe casing of said step of applying pressing forces has ends, said ends are open in a region near the longitudinal edges of the slotted tube, and wherein said tool means has tool halves which move said ends toward one another to connect said pipe casing at said region near the longitudinal edges.

10. A method according to claim 8, wherein said providing step includes supplying two shoes for being fastened to the longitudinal edges of the slotted tube, and said step of applying pressing forces is carried out by a tool means having a stationary arm extending from said tool means for resting one of said shoes against and a piston for pressing the other shoe against said stationary arm.

11. A method according to claim 1, wherein said step of applying pressing forces includes forming the outer pipe of the double-walled pipe with a single mechanical movement by a linear action tool having three contact elements, wherein one of said elements is provided diametrically opposite the longitudinal edges, and the other two contact elements are provided in regions adjacent the longitudinal edges of the slotted tube.

12. A method according to claim 1, wherein said step of applying pressing forces includes forming the outer pipe of the double-walled pipe with a single mechanical movement by a linear action tool having four contact elements, wherein two of said contact elements are provided in first regions adjacent the longitudinal edges of the slotted tube, and said other two elements are provided in a region of the slotted tube diametrically opposite said first regions.

13. A method according to claim 1, wherein said step of applying pressing forces includes forming the outer pipe of the double-walled pipe with a single mechanical movement by a two-part shell-type tool having two shells, wherein each said shell grips around approximately one-half of the slotted tube measured from the longitudinal edges.

14. A method according to claim 1, wherein said step of applying pressing forces includes forming the outer pipe of the double-walled pipe with a single mechanical movement by a three-part shell-type tool, wherein said one shell grips around the slotted tube and is positioned diametrically opposite the longitudinal edges, and said other two shells grip around the slotted tube and are positioned in regions adjacent the longitudinal edges.

15. A method according to claim 1, further comprising providing a pipe casing having ends which are initially open in a region formed near the longitudinal edges of the slotted tube, and said step of applying pressing forces includes forming the outer pipe of the double-walled pipe with a single mechanical movement by a tool means having tool halves for moving said ends toward one another to contact the pipe casing in said region formed near the longitudinal edges.

16. A method according to claim 1, wherein said providing step includes supplying two shoes, fastening said two shoes to the longitudinal edges of the slotted tube, and said step of applying pressing forces is carried out by a tool means having a stationary arm extending from said tool means for resting against one of said shoes and a piston for pressing said other shoe toward said stationary arm.

17. A method according to claim 1, wherein said step of applying pressing forces includes applying pressure to place the longitudinal edges in tight abutting relationship along a longitudinal abutment line and to form the outer pipe of the double-walled pipe with a single mechanical movement.

18. A method according to claim 1, wherein said step of applying pressing forces includes forming the outer pipe of the double-walled pipe with a single mechanical movement by a tool means comprising a multiple-part shell-type tool, and wherein said shell-type tool has an inner diameter corresponding to the outer diameter of the slotted tube.

19. A method according to claim 1, wherein said step of applying pressing forces includes forming the outer pipe of the double-walled pipe with a single mechanical movement by a tool means comprising a linear action tool having three contact elements, wherein one of said elements is provided diametrically opposite the longitudinal edges of the starting sheet, and the other two contact elements are provided in regions adjacent the longitudinal edges of the slotted tube.

* * * * *